US012564277B2

(12) United States Patent
Chan et al.

(10) Patent No.: US 12,564,277 B2
(45) Date of Patent: Mar. 3, 2026

(54) EXPANDABLE MATTRESS COVER

(71) Applicant: Standard Fiber, LLC, Burlingame, CA (US)

(72) Inventors: Chun Leung Chan, San Francisco, CA (US); Jing Lou, San Francisco, CA (US)

(73) Assignee: Standard Fiber, LLC, Burlingame, CA (US)

( * ) Notice: Subject to any disclaimer, the term of this patent is extended or adjusted under 35 U.S.C. 154(b) by 400 days.

(21) Appl. No.: 18/079,654

(22) Filed: Dec. 12, 2022

(65) Prior Publication Data

US 2023/0180949 A1 Jun. 15, 2023

Related U.S. Application Data

(60) Provisional application No. 63/289,894, filed on Dec. 15, 2021.

(51) Int. Cl.
*A47G 9/02* (2006.01)
*A47G 9/04* (2006.01)

(52) U.S. Cl.
CPC ..... *A47G 9/0246* (2013.01); *A47G 9/04* (2013.01)

(58) Field of Classification Search
CPC .... A47C 31/105; A47C 31/10; A47G 9/0246; A47G 9/04; A47G 9/0238; A44B 19/00
USPC ..... 5/497, 496, 502, 500, 720, 499, 11, 692, 5/723, 486
See application file for complete search history.

(56) References Cited

U.S. PATENT DOCUMENTS

2016/0100697 A1* 4/2016 Prochazka ..... A47G 9/04 5/720
2019/0350376 A1* 11/2019 Kittaneh ..... A47C 31/105

FOREIGN PATENT DOCUMENTS

WO WO-2004002272 A2 * 1/2004 ..... A47C 21/026

* cited by examiner

*Primary Examiner* — David R Hare
*Assistant Examiner* — Joseane E. Tejada
(74) *Attorney, Agent, or Firm* — Dax D. Anderson; Kirton McConkie

(57) ABSTRACT

A mattress cover includes a bottom panel, a top panel, a fixed side panel joined to the bottom panel and an expansion side panel joined to the fixed side panel and to the top panel. A fully separable expansion closure has a first part at an expansion panel upper edge and a second part at an expansion panel lower edge. When the expansion panel closure parts are engaged, the expansion panel is in an unexpanded state to define a first interior volume of the cover and the cover accommodates mattresses of a height in a first range of heights. When the expansion panel closure parts are disengaged, the expansion panel is in an expanded state to define a second interior volume of the cover larger than the first interior volume, and the mattress cover accommodates mattresses of a height in a second range of heights larger than the first range of heights.

10 Claims, 2 Drawing Sheets

EXPANDABLE MATTRESS COVER

BACKGROUND

The following description relates to a mattress cover or ticking, and more particularly to an expandable mattress cover that can be used with mattresses of differing heights.

Mattress covers, also referred to as ticking, are the outermost covering for a mattress. A typical mattress cover is fabricated from a tightly woven cotton, poly or cotton/poly blend textile material. These covers are designed to protect the mattress as well as to protect the person sleeping on the mattress. Mattress covers are distinguished from mattress pads or protectors in that they are part of the manufacture or fabrication of a mattress. That is, they are a manufacturer applied outermost covering of the mattress.

Mattresses are available in a wide variety of heights or thicknesses. Mattress heights can vary from 5 inches to as much as 21 inches, the most common mattress heights being 8, 10 and 12 inches. Typically, a mattress manufacturer will manufacture a variety of mattresses spanning all or some range of heights.

Standard mattress covers are likewise provided in distinct heights from 8 inches to as much as 18 inches for each distinct mattress height, with the most common heights being 8, 10 and 12 inches. As such, mattress manufacturers must maintain an inventory of mattress covers that span the range of mattress heights for mattresses that they manufacture. This can be problematic when covers for a given mattress height are not available in inventory for mattresses in production, or when there are too many covers for a mattress height that is not in demand or is no longer manufactured.

Accordingly, it is desirable to provide a mattress cover that can be used with a variety of mattress heights. Desirably, such a cover can be readily adapted for use with differing mattress heights with minimal labor required to make such a change. More desirably still, such a mattress cover can reduce the number of different covers needed in inventory to maintain manufacturing production levels.

SUMMARY

In one aspect, an expandable mattress cover or ticking includes a bottom panel, a top panel opposite the bottom panel, a fixed side panel, an expansion side panel and a top panel. The fixed side panel has an upper edge and a lower edge. The lower edge of the fixed side panel is joined to the bottom panel. The expansion side panel has an upper edge and a lower edge. The lower edge of the expansion side panel is joined to the upper edge of the fixed side panel and the upper edge of the expansion panel joined to the top panel.

A fully separable expansion closure has a first part at the expansion panel upper edge and a second part at the expansion panel lower edge. When the expansion panel closure first and second parts are fully engaged with one another the expansion panel is in an unexpanded state to define a first interior volume of the mattress cover and the mattress cover accommodates mattresses of a first range of heights. When the expansion panel closure first and second parts are fully disengaged with one another the expansion panel is in an expanded state to define a second interior volume of the mattress cover larger than the first interior volume of the mattress cover and the mattress cover accommodates mattresses of a second range of heights larger than the first range of heights.

In an embodiment, the mattress cover further includes a mattress closure positioned between the bottom panel and the fixed side panel. The mattress closure is openable to access an interior of the cover for inserting a mattress into the interior space. The mattress closure can be, for example, a zipper. The zipper can be a closed end zipper. In embodiments, the fully separable expansion closure is a separating zipper.

The expansion panel has a height that can be about 20% to 25% of a height of the fixed side panel. Alternatively, the expansion panel can have a height that is less than about 20% of a height of the fixed side panel, or the expansion panel can have a height that is greater than about 25% of a height of the fixed side panel. In an embodiment, the fixed panel height is about 8 inches and the expansion panel height is about 2 inches. In another embodiment, the fixed panel height is about 10 inches and the expansion panel height is about 2 inches.

Other objects, features, and advantages of the disclosure will be apparent from the following description, taken in conjunction with the accompanying sheets of drawings, wherein like numerals refer to like parts, elements, components, steps, and processes.

DETAILED DESCRIPTION

Figure 1:
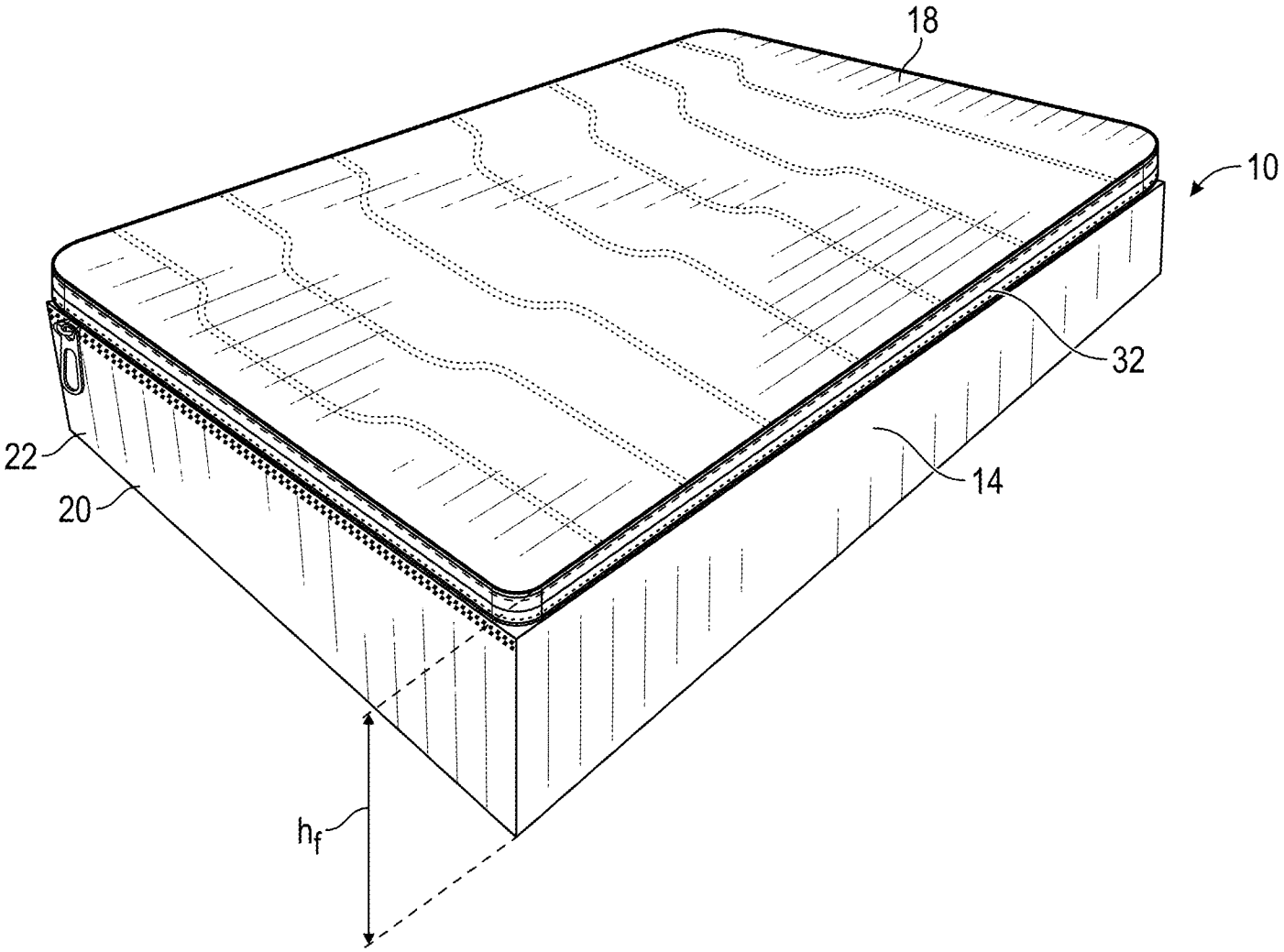
FIG. 1 is an illustration of an expandable mattress cover in an unexpanded or contracted state according to an embodiment described herein.

While the present disclosure is susceptible of embodiment in various forms, there is shown in the drawings and will hereinafter be described one or more embodiments with the understanding that the present disclosure is to be considered illustrative only and is not intended to limit the disclosure to any specific embodiment described or illustrated.

Figure 2:
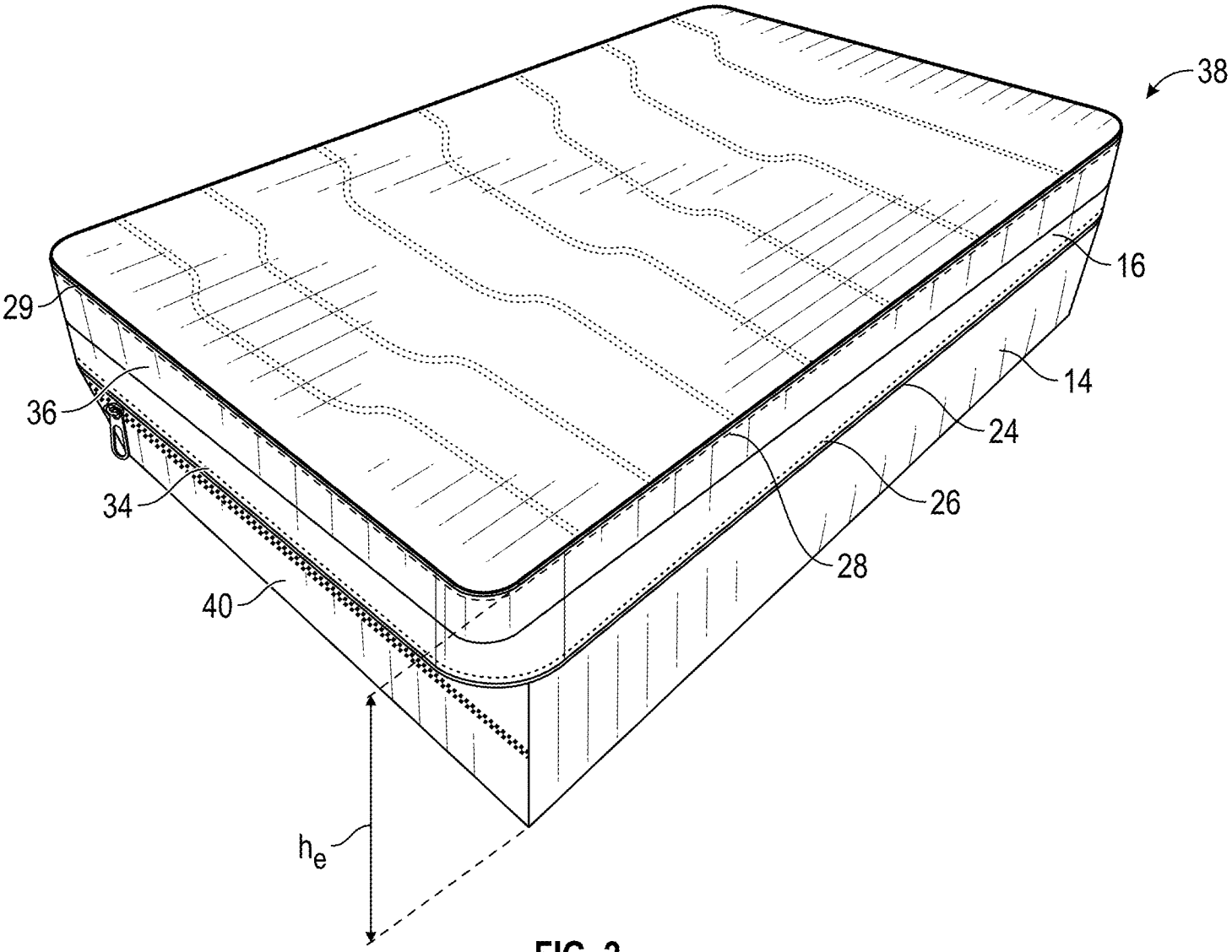
FIG. 2 is an illustration of the expandable mattress cover in an expanded state.

FIGS. 1 and 2 are perspective schematic illustrations of an expandable mattress cover 10 according to an embodiment described herein. FIG. 1 shows the cover 10 in an unexpanded or contracted state on a mattress and FIG. 2 shows the cover 10 in an expanded state.

The cover 10 includes, generally, a base or bottom panel 12, a fixed side panel 14, an expansion side panel 16 (referred to herein as the expansion panel) and a top panel 18. As described below, a variable volume interior region or space 20 is defined by the bottom panel 12, fixed side panel 14, expansion side panel 16 and top panel 18.

The fixed side panel 14 is joined to and extends upwardly from the bottom panel 18 a predetermined height $h_f$. A first or mattress closure 22 is positioned between the bottom panel 12 and the fixed side panel 16 and is configured to open to access the interior 20 of the cover 10. The mattress closure 22 is provided for inserting a mattress into the cover 10 and is closed once the mattress is positioned in the cover 10. This is intended to be a manufacturer carried out procedure.

In a current embodiment, the mattress closure 22 is a zipper, such as a closed bottom or closed end zipper, in which the mating teeth are retained joined to one another at an end or bottom of the zipper by, for example, a zipper stop. This is so that the zipper is opened for inserting a mattress into the cover and 10 is closed to contain the mattress.

The expansion panel 16 is joined to the fixed side panel 14 at about an upper edge 24 of the fixed side panel 14, and a lower edge 26 of the expansion panel 16. The top panel 18 is joined to the expansion panel 16 at about an upper edge 28 of the expansion panel 16. The panels 14/16 can be joined to one another by stitching or the like. In embodiments, the expansion panel upper edge 28 is fully joined to the top panel 18 at a periphery 29 of the top panel 18, and the expansion panel lower edge 26 is fully joined to the fixed side panel upper edge 24. In this configuration there is no access to the interior 20 of the cover 10 at the top panel 18/expansion side panel 14 juncture 38 or at the expansion panel 16/fixed side panel 14 juncture 40.

A second or expansion closure 32 has a first part 34 at about and joined to the expansion panel lower edge 26 and a second mating part 36 at about and joined to the expansion panel upper edge 28. The expansion closure 32 is a fully separable closure such that when in an open state the first and second parts 34, 36 are fully separated from one another.

In a current embodiment the expansion closure 32 is a zipper, such as a separating zipper. In this manner, the two portions of the zipper, that is, the two portions 34, 36 of the zipper tape/teeth can be fully separated from one another. Such zippers typically include a retainer box on one tape/teeth end and an insertion pin on the other tape/teeth end. As such, when the expansion zipper 32 is closed, the expansion panel 16 is contracted or unexpanded as seen in FIG. 1 to define a first, smaller interior volume 20*a*, and when the expansion zipper 32 is open, the expansion panel 16 can be fully expanded as seen in FIG. 2 to define a second, larger interior volume 20*b*.

In a current embodiment, the fixed side panel 14 has a predetermined height $h_f$, such as 8 inches, and in the unexpanded state, the cover 10 accommodates a lower height mattress. The expansion panel 16 likewise has a predetermined height $h_e$, such as 2 inches, so that in the expanded state, the cover 10 can accommodate mattresses having heights up to about 10 inches. In another embodiment, the fixed side panel 14 has a predetermined height $h_f$, such as 10 inches, and in the unexpanded state, the cover 10 accommodates a lower height mattress. The expansion panel 16 likewise has a predetermined height $h_e$, such as 2 inches, so that in the expanded state, the cover 10 can accommodate mattresses having heights up to about 12 inches. That is, in these embodiments, the expansion panel can have a height that is about 20% to 25% of a height of the fixed side panel. Other embodiments are anticipated, for example, an 8 inch high fixed side panel 14 and a 4 inch high expansion panel 16 to accommodate mattresses from about 8 inches to about 12 inches, a 14 inch high fixed side panel 14 and a 4 inch high expansion panel to accommodate mattresses having heights of 14 inches to 18 inches.

This arrangement provides tremendous flexibility and economies of scale for mattress manufacturers. Having, for example, only 2 different size covers 10, each of which can accommodate a range of mattress heights is a savings in inventory, inventory management, costs and labor. It also reduces the likelihood of waste when, for example, a particular height mattress is discontinued.

The ability to expand a cover 10 size also allows the manufacturer to add layers on top of a mattress, inside of the cover 10. For example, one or more additional layers can, with the cover 10 unexpanded, create a Euro or tight-top mattress, while the same cover can be used in the expanded state to create a pillow top mattress. The layers can also be used to provide different comfort levels. These comfort layers can be used to increase or decrease softness and/or firmness of the mattress as desired. The expandable cover 10 also allows for changing from a pillow top mattress (extra layer of cushioning on top of the mattress with the cover in an expanded state or a Euro top mattress (additional layer of cushioning, as noted above, inside of the cover 10, with the cover in an unexpanded state).

It will also be appreciated by those skilled in the art that the top panel 18 of the cover 10 can be formed from a wide variety of materials. It is anticipated that the top panel 18, fixed side panel 14, and bottom panel 12 will, for example, be formed from typical cover materials, such as tightly woven cotton, poly or cotton/poly blend textile material, or a knitted material. Likewise, it is anticipated that the expansion panel 16 will be made from tightly woven cotton, poly or cotton/poly blend textile material to provide the same wearability and durability as the top 18, fixed side 14 and bottom 12 panels. It will also be appreciated that the various panels (bottom 12, fixed side 14, expansion 16 and top 18 panels) can be fabricated from different materials as desired by the cover or mattress manufacturer.

It is understood that the examples described above and shown in figures are not limiting. Various combinations of the different features described above, including different combinations of materials, layers and closures are envisioned. That is, various features from one of the embodiments above may be implemented and/or used together with other embodiments described herein.

It should also be understood that various changes and modifications to the presently disclosed embodiments will be apparent to those skilled in the art. Such changes and modifications can be made without departing from the spirit and scope of the present disclosure and without diminishing its intended advantages. It is therefore intended that such changes and modifications be covered by the appended claims.

The invention claimed is:

1. A mattress cover comprising:

a bottom panel;

a top panel opposite the bottom panel;

a fixed side panel having an upper edge and a lower edge, the lower edge of the fixed side panel joined to the bottom panel;

an expansion side panel having an upper edge and a lower edge, the lower edge of the expansion side panel joined to the upper edge of the fixed side panel, the upper edge of the expansion panel joined to the top panel; and a fully separable expansion closure having a first part at the expansion panel upper edge and a second part at the expansion panel lower edge, wherein when the expansion panel closure first and second parts are fully engaged with one another the expansion panel is in an unexpanded state to define a first interior volume of the mattress cover and the mattress cover accommodates mattresses of a height in a first range of heights and when the expansion panel closure first and second parts are fully disengaged with one another the expansion panel is in an expanded state to define a second interior volume of the mattress cover larger than the first interior volume of the mattress cover and the mattress cover accommodates mattresses of a height in a second range of heights larger than the first range of heights.

2. The mattress cover of claim 1 further including a mattress closure positioned between the bottom panel and the fixed side panel, the mattress openable to access an interior of the cover.

3. The mattress cover of claim 2, wherein the mattress closure is a zipper.

4. The mattress cover of claim 3, wherein the zipper is a closed end zipper.

5. The mattress cover of claim 1, wherein the fully separable expansion closure is a separating zipper.

6. The mattress cover of claim 1, wherein the expansion panel has a height that is about 20% to 25% of a height of the fixed side panel.

7. The mattress cover of claim 1, wherein the expansion panel has a height that is less than about 20% a height of the fixed side panel.

8. The mattress cover of claim 1, wherein the expansion panel has a height that is greater than about 25% of a height of the fixed side panel.

9. The mattress cover of claim 6, wherein the fixed panel height is about 8 inches and wherein the expansion panel height is about 2 inches.

10. The mattress cover of claim 6, wherein the fixed panel height is about 10 inches and wherein the expansion panel height is about 2 inches.

* * * * *